United States Patent [19]

Cruse

[11] Patent Number: 4,920,876

[45] Date of Patent: May 1, 1990

[54] REFUSE COMPACTOR

[76] Inventor: Harry R. Cruse, 4351 Imperial Dr., West Linn, Oreg. 97068

[21] Appl. No.: 166,673

[22] Filed: Mar. 11, 1988

[51] Int. Cl.[5] ..... B30B 15/14

[52] U.S. Cl. ..... 100/48; 100/53; 100/289; 184/66; 184/71

[58] Field of Search ..... 100/48, 53, 218, 242, 100/255, 230, 283, 289, 286; 184/65, 66, 71, 73, 74, 76, 78, 80, 82; 74/424.8 NA, 424.8 YZ, 216.3

[56] References Cited

U.S. PATENT DOCUMENTS

| | | | |
|---|---|---|---|
| 194,199 | 8/1877 | Weigle | 184/73 |
| 338,661 | 3/1886 | Freligh | 184/71 |
| 628,701 | 7/1899 | Dyer | 100/289 |
| 767,315 | 8/1904 | Sneed | 100/289 |
| 901,039 | 10/1908 | Rank | 184/82 |
| 1,737,390 | 11/1929 | Roe | 74/216.3 |
| 2,432,215 | 12/1947 | Stocker | 100/53 |
| 3,095,804 | 7/1963 | Lindner | 100/53 |
| 4,088,071 | 5/1978 | Cruse et al. | 100/53 |
| 4,155,297 | 5/1979 | Smith et al. | 100/53 X |
| 4,781,568 | 11/1988 | Inaba | 100/290 X |

*Primary Examiner*—Stephen Marcus
*Assistant Examiner*—Christine A. Peterson
*Attorney, Agent, or Firm*—Klarquist, Sparkman, Campbell, Leigh & Whinston

[57] ABSTRACT

A refuse compactor includes a refuse container housing an upright compaction ram actuated by a vertically oriented scissors mechanism. The scissors mechanism is actuated by vertical movement of a horizontal crossbar connected to one set of scissors arms. The crossbar is moved by a vertically suspended ball screw acting on a ball nut floatingly connected to the cross bar. The ball screw is suspended at its upper, driven end in thrust bearings while its lower end is unrestrained. An oiler automatically oils the ball screw upon each inversion and return of the container to an upright condition in dumping refuse. An automatic ram cycler periodically extends and retracts the ram to prevent it and the compacted refuse in the container from freezing to the container when ambient air temperatures drop below freezing.

12 Claims, 3 Drawing Sheets

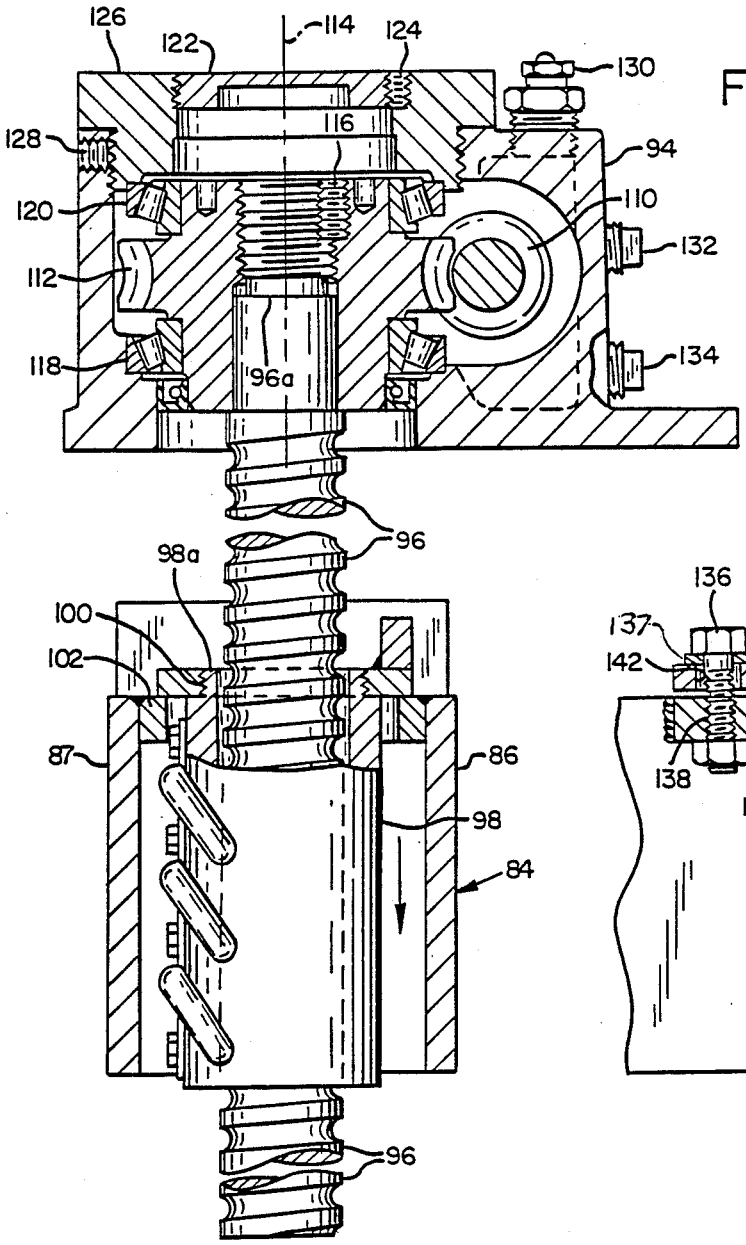
FIG. 5
FIG. 6
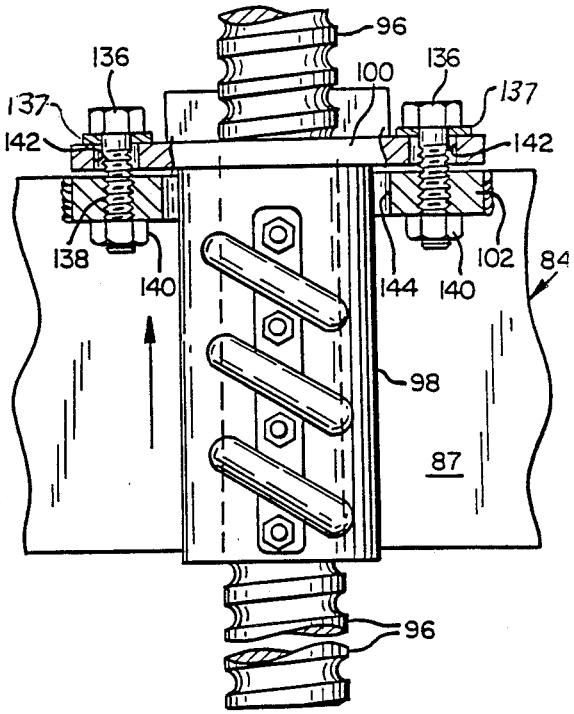
FIG. 2
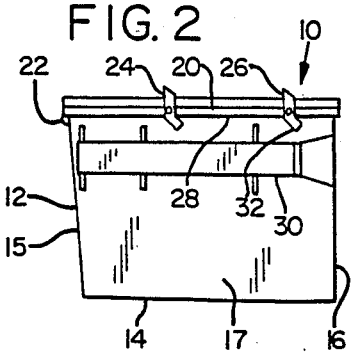
FIG. 3
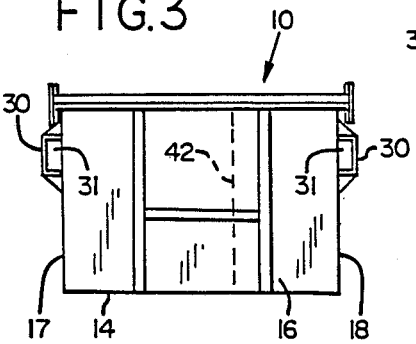
FIG. 4
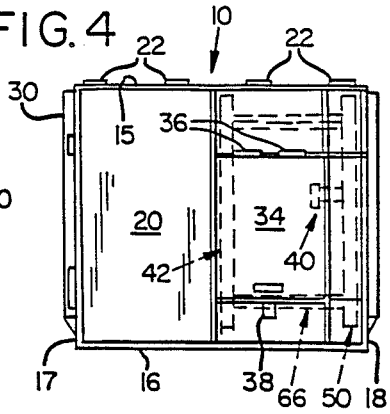

REFUSE COMPACTOR

BACKGROUND OF THE INVENTION

The present invention relates to a mechanically actuated refuse compactor of the type in which a reciprocating ram within a refuse container compacts refuse against an interior wall of the container.

The present refuse compactor is an improvement over the refuse compactor disclosed in my prior U.S. Pat. No. 4,088,071. Although the compactor of such prior patent was a substantial improvement over the prior art and has been commercially successful, experience with such compactor's ram actuator drive mechanism has revealed certain deficiencies in need of correction for optimum performance.

One such deficiency relates more to the users than to the apparatus. Typical users of the compactor are not knowledgeable about the maintenance of mechanical equipment and could not be relied upon to lubricate the mechanical drive mechanism on a regular basis. As a result, mechanical breakdowns were sometimes caused by lack of regular lubrication of moving parts. Therefore there has developed a need for means for automatically lubricating the ram drive mechanism at regular intervals.

Another deficiency is the need for maintaining precise alignment of the mechanical ball screw actuator drive with the driven ram actuator. The vertical ball screw is anchored at its opposite ends in bearings, and extends through a ball nut which is rigidly connected to the mechanical ram actuator assembly. Such rigid mounting of the ball screw and nut require precise alignment of the ball screw with the actuator. It has been found through experience that such precise alignment is difficult to maintain with prolonged use and that misalignment can lead to excessive wear, binding and malfunction of the actuator drive. Accordingly, there is a need for an improved ram actuator drive to solve the misalignment problem.

A third deficiency, is the unreliability of the compactor's operation in cold weather. The compactor is typically used to compact moisture laden refuse from grocery stores and restaurants. Such semi-dry refuse when compacted tends to cause water and other liquids to collect in the bottom of the container and along the outer surface of the compacted refuse. During prolonged periods of subfreezing temperatures, ice formed within the container and especially along its floor can cause the ram to freeze up and the compacted refuse to freeze to the inside walls of the container, preventing the ram from operating and the compacted refuse from being dumped when the container is inverted.

SUMMARY OF THE INVENTION

To overcome the foregoing problems with the compactor of Pat. No. 4,088,071, the present invention provides an improved ram actuator drive incorporating a unique self-aligning ball screw drive assembly, means for automatically oiling the drive assembly at intervals during use of the compactor, and means for automatically activating the ram actuator drive periodically to cycle the ram and thereby prevent it from becoming frozen within ice in the container and compacted refuse from freezing to the container walls during periods of below freezing ambient air temperatures.

Objectives of the invention are to provide a compactor of the general type shown in U.S. Pat. No. 4,088,071 with an improved ram actuator drive means including:

(1) means operable automatically during periods of subfreezing ambient air temperatures to prevent the ram from freezing up and refuse from freezing to the walls of the container;

(2) means operable automatically during use of the compactor to oil the ram actuator drive mechanism; and (3) means mounting the ram actuator drive means for self-aligning movement to minimize wear and prevent its malfunction.

The foregoing and other objects, features and advantages of the present invention will become more apparent from the following detailed description which proceeds with reference to the accompanying drawings.

BRIEF DESCRIPTION OF DRAWINGS

FIG. 2 is a side view of the refuse container of the compactor;

FIG. 3 is a front view of the container of FIG. 2;

FIG. 4 is a top view of the container of FIGS. 2 and 3;

FIG. 5 is a foreshortened sectional view of the actuator drive assembly taken along the line 5—5 of FIG. 1;

FIG. 6 is a view, partly in section, as viewed from the line 6—6 of FIG. 1;

DETAILED DESCRIPTION OF A PREFERRED EMBODIMENT

General Assembly

Figure 1:
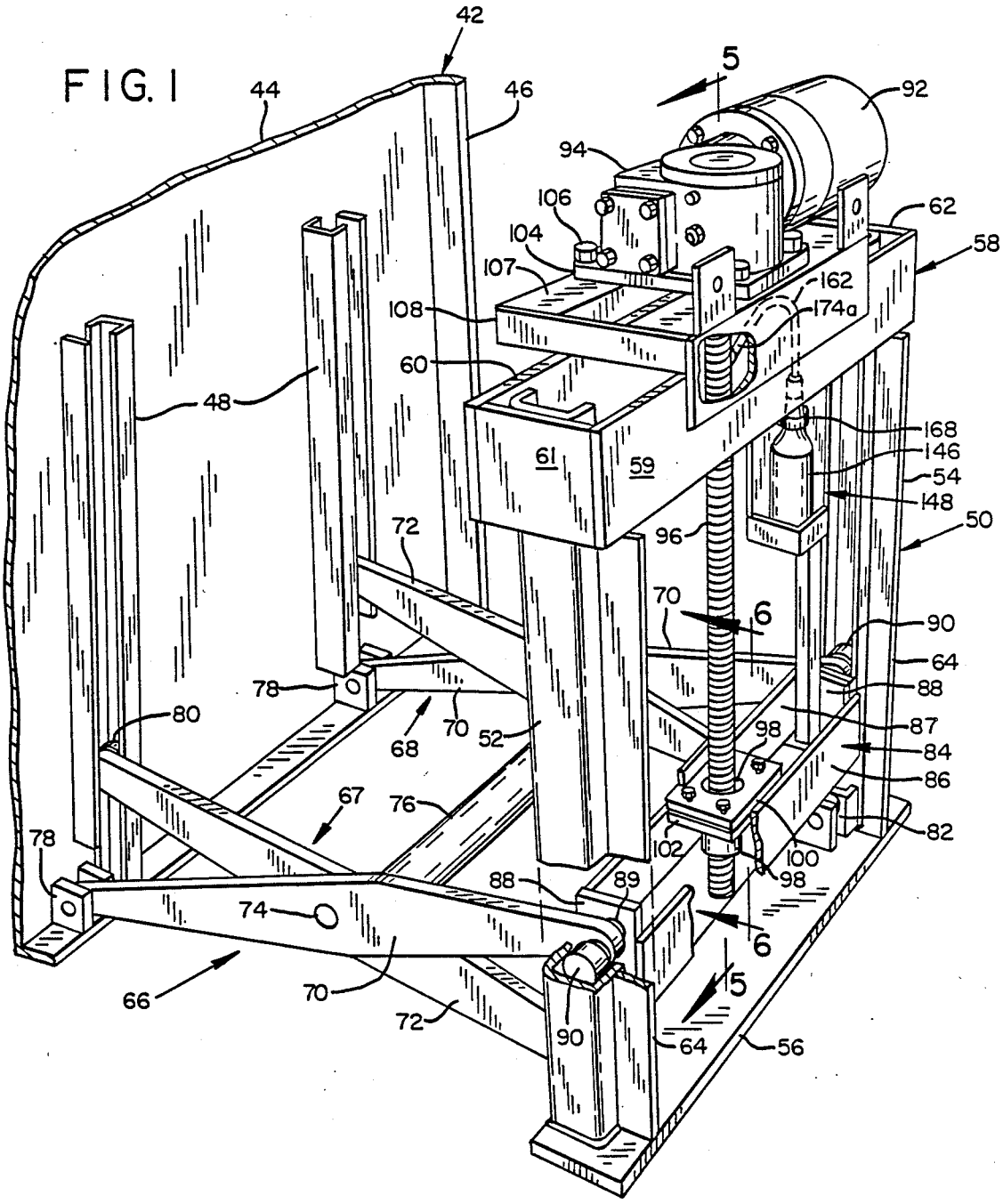
FIG. 1 is a perspective view of the mechanical ram actuator and actuator drive assembly of a compactor in accordance with the invention.

Except for the improvements described in detail hereinafter, the compactor of the present invention has all of the features of the compactor described in the aforementioned U.S. Pat. No. 4,088,071, including the control and safety features thereof. Therefore the disclosure of U.S. Pat. No. 4,088,071 is incorporated herein by reference, especially for a more detailed description of the control and safety features and other detailed features of the compactor which are not the subject of the improvements of the present invention.

Referring first to FIGS. 2–4 the refuse compactor shown generally at 10 includes a refuse container 12 with a bottom wall 14, rear wall 15, opposite front wall 16, and a pair of opposite end walls 17, 18. The open top of the container is closed by a dump lid 20 hinged to the rear wall at 22. The lid is normally latched in its closed position by lid latches 24, 26 pivoted to the opposite end walls and interconnected by a connecting rod 28.

Each end wall 17, 18 is provided with a longitudinal fork pocket 30 having a front end opening 31 for receiving a lifting fork of a materials handling vehicle such as a front or rear end loader. The forks are used to lift and invert the container to dump its compacted refuse contents. The lid latches 24, 26 include a linkage 32 to an actuator (not shown) within lifting pocket 30 operable to automatically unlatch lid 20 when a lifting fork is inserted in the pocket. Thus, when the container is inverted, the lid swings open about its hinges, and the compacted refuse is dumped from the container. Details of such fork actuated unlatching mechanism will be found in the aforementioned U.S. Pat. No. 4,088,071.

Referring to FIG. 4, lid 20 incorporates a loading door 34 hinged to the lid along its rear edge at 36 and latched to the lid by a door latch 38 having a safety locking mechanism as described in the aforementioned patent. The loading door and an adjacent portion of the lid incorporate magnetic switch means 40. Switch means 40 is in a ram drive activating electrical circuit and operates to activate the ram drive means to cycle the ram through a complete operating cycle each time the loading door is opened and reclosed. A more complete description of the ram drive motor operating circuit in which the magnetically actuated lid switch 40 is incorporated is found in U.S. Pat. No. 4,088,071. Loading door latch 38 also includes a safety feature which locks the latch in a closed position whenever the compaction ram is extended, in a manner described in the aforementioned U.S. patent.

Ram Actuator Assembly and Drive

Referring now especially to FIG. 1, the compaction ram and its connected mechanical actuating means and actuator drive assembly, all mounted within the container as a unit, will now be described. The compaction ram means is a ram assembly 42 comprising a rigid heavy gauge upright metal compaction plate 44 reinforced by peripheral frame members 46. A pair of laterally spaced apart and vertically extending intermediate roller guide tracks 48 extend vertically along the rear surface of the compaction plate near its lower edge and help reinforce the plate.

The ram assembly 42 is connected to an upright base frame 50 for extension and retraction by a mechanical scissors-type actuator linkage assembly 66. Base frame 50 includes a pair of opposite side frame channels 52, 54 interconnected at their lower ends by a bottom cross frame plate 56 and at their upper ends by a top box-like cross frame 58. Frame 58 includes a front cross frame plate 59, rear cross frame plate 60 and opposite end frame plates 61, 62. Opposite side frame channel members 52, 54 include rearwardly extending reinforcement flanges 64 especially for increasing the bending strength of the channel members in a fore-and-aft direction.

Scissors actuator assembly 66 is made up of two sets 67, 68 of scissors arms, each set including an upper scissors arm 70 and a lower scissors arm 72 pivoted together at 74 for relative movement about a transverse axis. For rigidifying the assembly, the two sets of arms are interconnected by a pivot tube 76. The forward ends of upper scissors arms 70 are pivoted to ram 42 at clevises 78 along a lower edge of the ram. The forward ends of lower scissors arms 72 are connected by rollers 80 in tracks 48 of the ram for travel vertically in the tracks. The rear ends of the lower scissors arms 72 are pivoted to bottom plate 56 of base frame 50 at clevises 82. The rear ends of upper scissors arms 70 are pivoted to the opposite ends of a scissors actuator means in the form of a horizontal cross bar actuator 84 vertically movable along base frame 50.

More specifically, cross bar actuator 84 is a box frame member made up of a pair of cross frame plates 86, 87 interconnected by end plates 88. Each end plate 88 carries an outwardly projecting roller shaft 89 mounting a roller 90 for travel along the vertical track defined by each of side frame channels 52, 54. The rear ends of upper scissors arms 70 are pivoted to roller shafts 89. Thus vertical movement of the cross bar actuator 84 actuates scissors linkage assembly 66 to extend and retract ram 42. Upward movement of actuator 84 retracts the ram, and downward movement of actuator 84 extends the ram. To accomplish this, actuator drive means are provided as described below.

Referring especially to FIGS. 1, 5 and 6, the actuator drive means includes a reversible electric drive motor 92 having an output shaft (not shown) connected to a gear reducer 94 driving a vertically extending ball screw 96. Ball screw 96 is drivingly connected to a ball nut 98 firmly mounted to a ball nut carrier plate 100. Carrier plate 100 is connected to a pressure plate 102 rigidly affixed to cross bar actuator 84. More specifically, plate 102 spans the distance between front and rear cross plates 87, 88 of actuator 84 midway between its ends. Thus when motor 92 rotates ball screw 96 in one direction, scissors actuator 84 moves upwardly along base frame 50 to retract ram 42. When the motor rotates ball screw 96 in the opposite direction, actuator 84 moves downwardly along the base frame to extend ram 42 and thereby compact refuse against an interior end wall 17 of the container. The position of the ram in its container and its actuating assembly are depicted in hidden lines in FIG. 4 with the ram extended.

Motor 92 and gear reducer 94 are mounted on top of base frame 50 away from any liquid that may accumulate in the bottom of the container. The means for mounting the motor and gearbox includes a mounting plate 104 fastened by screws 106 to top plates 107 of an open box frame member 108. Box frame member 108 is in turn secured as by welding to the upper cross frame 58 of base frame 50.

Ball Screw Drive

The details of the ball screw mounting and drive are shown best in FIGS. 5 and 6. Gear reducer 94 includes a worm gear 110 meshing with a bull gear 112 having a vertical axis 114 coincident with the vertical axis of ball screw 96. The upper end of ball screw 96 is threaded at **96*a* into the hub of bull gear 112. The ball screw is secured against rotation relative to the bull gear by a set screw 116. Bull gear 112 is mounted in bearing means to suspend the ball screw 96 vertically from the gearbox. These bearing means include a lower thrust bearing 118 and an upper thrust bearing 120, each being a tapered roller bearing of conventional construction. Lower thrust bearing 118 resists downward thrust imposed by ball screw 96 when raising ram actuator 84. Upper thrust bearing 120 resists upward thrust of ball screw 96 when it is driving ram actuator 84 downward. Gearbox 94 includes an inspection cap 122 secured in position by a set screw 124. The inspection cap is within a larger diameter threaded gearbox cover 126 which may be secured in place by a set screw 128. The gearbox also includes the usual vent cap 130, oil filler cap 132, and oil drain cap 134**.

As will be apparent from FIGS. 1 and 5, ball screw 96 is totally unrestrained at its lower end both vertically and laterally. It is restrained only at its upper end rotary suspension mounting by bull gear 112 and its supporting bearings 118, 120. Therefore, except for any restraints imposed by actuator cross bar assembly 84, ball screw 96 is free to deflect in any direction from its mounting.

Ball screw 96 is threaded through ball nut 98, which is of conventional construction. Ball nut 98 extends through a much larger diameter opening 144 in pressure plate 102 and is threaded at its reduced upper end 98*a* into a threaded opening of its carrier plate 100 so as to be firmly secured only to the carrier plate. Carrier plate 100, however, is only loosely connected to pressure plate 102 of scissors actuator 84, as will be most apparent from FIG. 6.

Four bolts 136 connect carrier plate 100 to pressure plate 102 of the actuator. Bolts 136 are threaded into and through threaded openings 138 of pressure plate 102 and are secured in a desired threaded relationship with such pressure plate by jam nuts 140. In connecting carrier plate 100 to pressure plate 102, bolts 136 extend through hardened steel washers 137 and much larger unthreaded openings 142 of the carrier plate. Washers 137 prevent the heads of bolts 136 from being drawn into openings 142 of the carrier plate when the ball nut lifts actuator 84 as shown in FIG. 6. Jam nuts 140 secure the bolts 136 to the pressure plate in a position such that there is both lateral free play and vertical free play between carrier plate 100 and pressure plate 102. Such a floating connection of the two plates actually provides limited universal free play between the two plates. Thus, ball screw 96 and its connected nut 98, both connected to floating carrier plate 100, are free to self-align relative to one another, free of any constraint of actuator member 84. This self-alignment capability is enhanced by the fact that the lower end of ball screw 96 is unrestrained. Therefore, it is unnecessary to maintain precise alignment between the axis of ball screw 96 and the generally vertical axis of movement of actuator member 84 as defined by the axis of opening 144 through pressure plate 102. Accordingly, no binding can develop between the ball screw and ball nut nor between the ball nut and actuator 84. As a result, any excess wear or binding of the ball screw and nut, and resultant breakage or malfunction, is avoided.

As shown in FIG. 5, when the ball screw 96 is driving the ball nut and thus actuator 84 downward to extend the ram, there is no gap between carrier plate 100 and pressure plate 102. There is a gap between the heads of bolts 136 and carrier plate 100. Downward driving force is transmitted to plate 102 of the actuator from the ball nut through plate 100. However, when the ball screw is lifting the ball nut to raise actuator 84 and retract the ram, there is an appreciable gap between carrier plate 100 and pressure plate 102 because of the vertical free play between the two plates. However, there is no gap between the heads of bolts 136 and carrier plate 100 because the lifting force of the ball nut is acting against washers 137 and those heads to lift the actuator 84. The amount of any such gap can be controlled by controlling the extent to which bolts 136 are threaded through pressure plate 102 and secured by jam nuts 140.

The described ball screw drive assembly also simplifies the proper alignment of the gear reducer 94 and its connected ball screw and nut during assembly of the drive with the actuator 84. The gear reducer is simply shifted in position on its mounting plates 107 until ball nut 98 is centered within the large hole 144 (FIGS. 5 and 6) through pressure plate 102. Then the gear reducer is fastened to its mounting plates with bolts 106 (FIG. 1).

Automatic Oiler

During operation of the compactor it is important that the ball screw and ball nut be kept well lubricated. In practice it has been found that this requires adding a minimum of at least a teaspoon of oil to the ball screw about every fifty ram operating cycles. The automatic oiler disclosed is designed to deliver approximately that amount of oil to the upper end portion of the ball screw each time the container is inverted to dump a load of compacted refuse and returned to its upright position. Such oiler means is, in effect, an automatic gravity oiler. It includes a transparent plastic bottle 146 in a mounting bracket 148 carried by base frame 50. Bracket 148 is open on two sides for observation of the oil level within container 146. Container 146 has a tapered neck 150 leading to an upper mouth 152 closed by a special screw cap 154. Cap 154 defines an internal tapered valve seat 156 leading to a passage 158 through a cap spout 160. Spout 160 is connected to a loop of flexible tubing 162. Bottle 146 serves as an oil storage vessel for ball screw lubricating oil 164.

Bottle 146 also contains a steel valve ball 166 for lodging in valve seat 156 when the bottle is inverted. As shown in FIG. 1, bottle 146 is strapped to its mounting bracket by a neck strap 168 to prevent it from falling from the bracket when it is inverted. Tube 162 extends upwardly from its connection with the spout of bottle cap 154 along first leg 162*a* of the loop to an apex 170 which is above the exposed upper end portion of ball screw 96 shown in FIG. 7. From its apex the tubing extends downward along a second leg 162*b* of the loop to a connection at 172 with a rigid oil delivery tube 174 secured to a mounting bracket 176 attached to a flange of gearbox 94. Oil delivery tube 174 includes a lower section 174*a* with a discharge opening 174*b* at the ball screw so that oil delivered through tube 174 is deposited on the ball screw.

Figure 8:
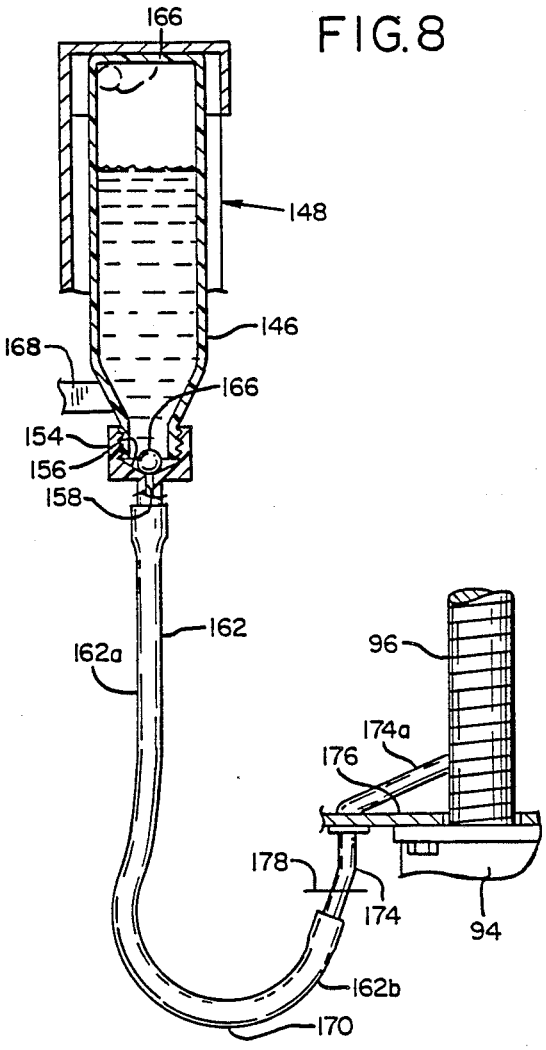
FIG. 8 is a view similar to FIG. 7 but with the container inverted.
Figure 9:
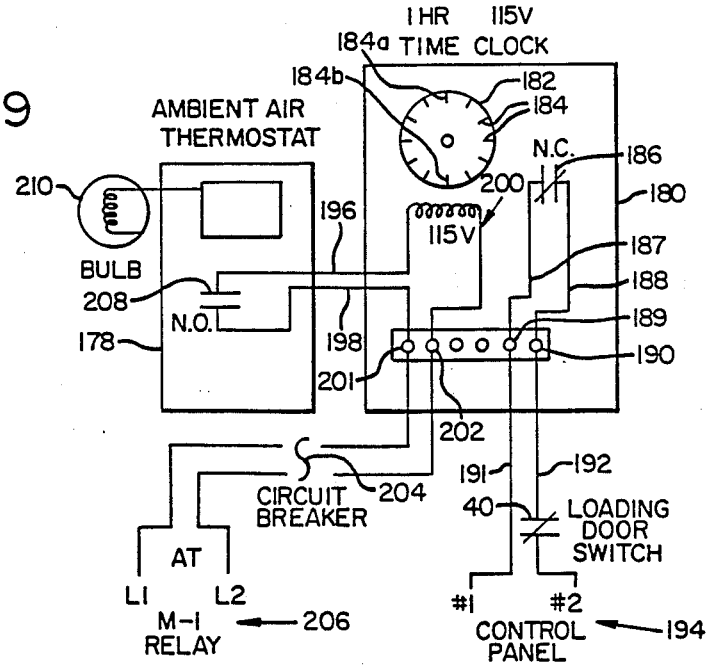
FIG. 9 is an electrical schematic of the automatic ram cycling mechanism of the invention.

When the described oiler assembly is inverted, such as when the entire compactor is inverted in dumping a load of refuse, the oiler assembly assumes the inverted orientation shown in FIG. 8. In such inverted position, oil flows out of bottle 146 through passage 158 in cap 154 and into tube 162. Oil continues to flow from the bottle into tube 162 until steel ball 166 falls under the influence of gravity through the oil in the bottle onto valve seat 158. By the time oil stops flowing from the bottle, tube 162 is filled with oil past its inverted apex 170 and into second leg 162*b* of the loop to a level 178 in oil discharge tube 174.

Figure 7:
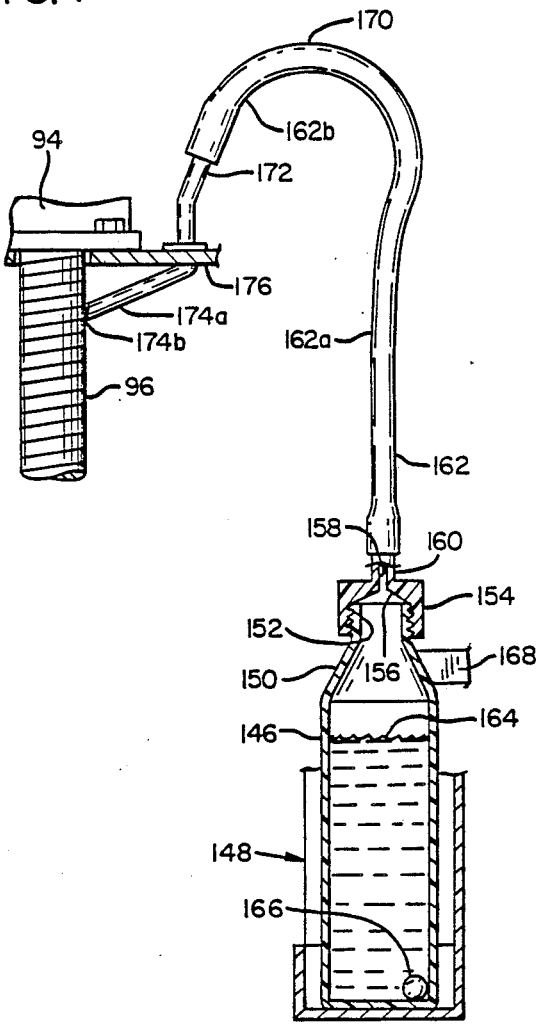
FIG. 7 is an enlarged view of the automatic oiler portion of the assembly shown in FIG. 1 when the container of the compactor is upright.

From the foregoing it will be apparent that when the container is returned to its upright position after dumping, thereby returning bottle 146 to its upright position shown in FIG. 7, oil in leg 162*b* of the loop flows through oil discharge tube 174 onto ball screw 96. The oil in the other leg 162*a* of the loop flows back into bottle 146 through cap passage 158, which is permitted because valve ball 166 unseats itself under such condition and drops back through the oil to the bottom of the bottle.

The foregoing assembly provides an automatic means of oiling the ball screw each time the compactor container is inverted to dump its contents and returned to its upright position. In practice, a 50 weight gear oil has been found to provide the necessary lubrication of the ball screw and a viscosity under a wide range of temperatures that will allow the second leg of the oil tube loop 162 to fill to a level that provides the desired amount of lubrication. The 50 weight oil provides good lubrication at temperatures as low as 0° F. A 5/16 inch oil passage in the bottle cap provides the desired oil flow through the cap and a ¾ inch diameter chromed steel ball bearing provides a satisfactory valve ball.

Automatic Ram Cycler

The control for the ram actuator drive includes an automatic ram cycler which operates periodically during subfreezing ambient air temperatures to prevent liquids in the bottom of the container from freezing and thereby preventing the ram from operating. The ram cycler also prevents the compacted refuse from freezing to the inside walls of the container, thereby ensuring that the refuse will be dumped when the container is inverted. The ram cycler is part of the control system for the ram actuator drive as described in U.S. Pat. No. 4,088,071.

The automatic cycler is depicted schematically in FIG. 8 and includes an ambient air thermostat 178 and a one hour timer 180. For example, the timer may be a conventional one-hour Dayton model 2E 130A repeat cycle timer. The timer includes a rotary dial 182 having a series of slots 184 set at 5 minute intervals around the 60 minute dial. By inserting an actuator tab (not shown) in desired slots 184, the timer can be set to open and reclose normally closed timer switch 186 at desired intervals to activate a controlled device. Timer switch 186 is connected by conductors 187, 188 to terminals 189 and 190 of the timer. These terminals are connected by conductors 191, 192 in the circuit of normally closed loading door switch 40. Conductors 191, 192 of such circuit are connected to the low voltage terminals of the M-1 motor start relay 206 for the compactor through control panel 194. When either timer switch 186 or door switch 40 is opened and reclosed, electric motor 92 is activated through motor control relay 206 or the equivalent in the motor control circuit. The motor operates in a first direction to extend the ram until a first limit switch is actuated. Then the motor operates in the reverse direction to retract the ram. When a second limit switch is actuated at the end of the retraction stroke, the motor is deenergized until one of the two switches 186, 40 is again opened and closed.

The ambient air thermostat 178 is connected by conductors 196, 198 in the 115 volt timer dial drive circuit indicated generally at 200. This circuit is connected through timer terminals 201, 202 and through a circuit breaker 204 to the continuous power source terminals L1, L2 of motor start relay 206. A normally open switch 208 in the thermostat circuit is closed when the thermostat senses, through its sensing bulb 210, an ambient air temperature below freezing, such as 30° F. Unless the thermostat switch 208 is closed in response to a predetermined cold ambient air temperature sensing, the timer will not operate, and the ram can only be operated by opening and reclosing loading door switch 40.

It has been found in practice that timer dial 182 should be set to cycle the ram at about 30 minute intervals under typical cold weather conditions, down to about 0° F. Under such conditions a switch actuator insert tab would be inserted in the slots **184*a* and 184*b* of the timer. Then assuming thermostat 178 senses an ambient air temperature of 30° or below, the normally open thermostat switch 208 closes, activating timer dial 182 in timer drive circuit 200. As timer dial 182 rotates, it opens and recloses timer switch 186 every thirty minutes. Each time that occurs, motor relay 206 closes in the motor circuit to energize motor 92. The motor remains energized to stroke the ram through a complete operating cycle. This action, of course, keeps ram 42** from freezing to the bottom of the container. The impact of the ram against refuse in the container also keeps the refuse dislodged from the interior walls of the container so that it can be dumped when the container is inverted.

Of course, loading door switch 40, being in the same circuit as timer switch 186, also causes the arm to operate through a complete operating cycle each time the loading door is opened and closed. Thus an opening and reclosing of either timer switch 186 or loading door switch 40 causes the arm to cycle by energizing M-1 relay 206.

In summary, the self-aligning ball screw, automatic oiler, and automatic ram cycler provide a substantially improved ram actuator drive. The improved drive is capable of operating for prolonged periods of time and under extremes of air temperature with minimal maintenance or repair.

Having illustrated and described the principles of my invention by what is presently a preferred embodiment, it should be apparent to persons skilled in the art that the invention as disclosed may be modified in arrangement and detail without departing from such principles.

I claim as my invention the disclosed embodiment and all modifications, variations and equivalents thereof coming within the true spirit and scope of the following claims:

1. In a refuse compactor including a container for receiving refuse, upright ram means within the container for compacting refuse against an upright wall of the container, ram activating means for extending and retracting the ram means toward and away from the upright wall including a generally vertically movable actuator, and actuator drive means for operating the vertically movable actuator including ball screw means, the improvement comprising:

said ball screw means including a generally vertically extending ball screw, bearing means vertically suspending said ball screw at its upper end for rotation about is vertical axis, said ball screw passing through and being drivingly connected to a ball nut connected to said actuator, the lower end of said ball screw being unrestrained, said ball nut being loosely connected to said actuator such that said ball screw and ball nut are self-aligning relative to said actuator and isolated from transverse loads imposed on said actuator by said ram means.

2. In the refuse compactor of claim 1, motor means drivingly connected to the upper end of said ball screw.

3. In the refuse compactor of claim 1, connector means loosely connecting said ball screw and ball nut to said actuator to allow generally horizontal limited free play between said actuator and said ball nut.

4. In the refuse compactor of claim 3, said connector means allowing generally vertical limited free play between said actuator and said ball nut.

5. In the refuse compactor of claim 3, said connector means comprising a generally horizontal connector plate rigidly connected to said ball nut and floatingly connected to a pressure plate of said actuator such that said connector plate and rigidly connected ball nut and screw are allowed limited universal free play relative to the pressure plate.

6. In the refuse compactor of claim 1, said actuator drive means including motor means drivingly connected to said ball screw at the upper end of said screw, and temperature-responsive control means operable to activate said motor means to actuate the ram means through an operating cycle of extension and retraction upon the sensing of predetermined low ambient air temperature to inhibit freezing of liquids within the container, the control means including timer means operable to activate said motor means to actuate the ram means through an operating cycle periodically during a period of said predetermined low ambient air temperatures.

7. In a refuse compactor including a container for receiving refuse, upright ram means within the container for compacting refuse against an upright wall of the container, ram activating means for extending and retracting the ram means toward and away from the upright wall including a generally vertically movable actuator, and actuator drive means for operating the vertically movable actuator including ball screw means, the improvement comprising:

said ball screw means including a generally vertically extending ball screw, bearing means vertically suspending said ball screw at its upper end for rotation about its vertical axis, said ball screw passing through and being drivingly connected to a ball nut connected to said actuator, the lower end of said ball screw being unrestrained, and oiler means operable automatically under a predetermined operating condition of the compactor to oil and ball screw, said predetermined operating condition being the inversion of said container and its return to an upright condition.

8. The refuse compactor of claim 7 wherein said oiler means includes an oil storage vessel having an opening at its upper end when the container is upright, conduit means leading in a partial loop upwardly in a first conduit section from the opening and then downwardly in a second conduit section from an apex of the loop to a discharge opening at an upper portion of the ball screw when the container is upright, such that (1) when the container is inverted, oil flows from the vessel through its opening into the first and second conduit sections of the loop, and (2) when the container is upright oil in the first section flows back into the vessel through its opening and oil in the second section flows through the discharge opening onto the ball screw.

9. The refuse compactor of claim 8 including valve means in the path of oil flow from the vessel through the loop to the ball screw, the valve means being normally open when the container is upright, the valve closing after a predetermined flow of oil from the vessel upon inversion of the container to limit the volume of oil leaving the vessel upon such inversion.

10. The refuse compactor of claim 9 including the refuse compactor of claim 8 wherein the valve means is a ball check valve including a valve seat at the vessel opening and a ball loose in the vessel and operable under the influence of gravity to drop through the oil in the vessel onto the valve seat upon each inversion of the container.

11. In a refuse compactor including a container for receiving refuse, upright ram means within the container for compacting refuse against an upright wall of the container, ram activating means for extending and retracting the ram means toward and away from the upright wall including a generally vertically movable actuator, and actuator drive means for operating the vertically movable actuator including ball screw means, the improvement comprising:

said ball screw means including a generally vertically extending ball screw, bearing means vertically suspending said ball screw at its upper end for rotation about its vertical axis, said ball screw passing through and being drivingly connected to a ball nut connected to said actuator, the lower end of said ball screw being unrestrained, means mounting said ball nut to said actuator for floating movement relative to the actuator to enable self-aligning movement of the ball screw and nut relative to the actuator, oiler means operable to oil the ball screw at predetermined intervals during use of the container, and control means operable to actuate the actuator and move the ram means through an operating cycle periodically during a sustained period of low ambient air temperatures to inhibit the freezing of liquids within the container to an extent that would cause the compactor to malfunction.

12. In a refuse compactor including a container for receiving refuse, upright ram means within the container for compacting refuse against an upright wall of the container, ram activating means for extending and retracting the ram means toward and away from the upright wall including a generally vertically movable actuator, and actuator drive means for operating the vertically movable actuator including ball screw means, the improvement comprising:

said ball screw means including a generally vertically extending ball screw, bearing means vertically suspending said ball screw at its upper end for rotation about its vertical axis, said ball screw passing through and being drivingly connected to a ball nut connected to said actuator, said actuator drive means including motor means drivingly connected to said ball screw at its upper end, temperature-responsive control means operable to activate said motor means to actuate the ram means through an operating cycle of extension and retraction upon the sensing of predetermined low ambient air temperatures to inhibit freezing of liquids within the container, the control means including timer means operable to activate said motor means to actuate the ram means through an operating cycle periodically during a period of said predetermined low ambient air temperatures.

* * * * *